US005713770A

United States Patent [19]

Ambli

[11] Patent Number: 5,713,770

[45] Date of Patent: Feb. 3, 1998

[54] WATER JET AGGREGAT FOR A VESSEL

[75] Inventor: Nils Ambli, Oslo, Norway

[73] Assignee: Kvaerner ASA, Oslo, Norway

[21] Appl. No.: 750,580

[22] PCT Filed: Jun. 16, 1995

[86] PCT No.: PCT/NO95/00105

§ 371 Date: Dec. 12, 1996

§ 102(e) Date: Dec. 12, 1996

[87] PCT Pub. No.: WO95/34467

PCT Pub. Date: Dec. 21, 1995

[30] Foreign Application Priority Data

Jun. 16, 1994 [NO] Norway ..... 942273

[51] Int. Cl.[6] ..... B63H 11/11; B63H 11/113

[52] U.S. Cl. ..... 440/41; 440/42

[58] Field of Search ..... 440/40, 41, 42, 440/43; 60/221; 239/265.19

[56] References Cited

U.S. PATENT DOCUMENTS

| | | | |
|---|---|---|---|
| 3,461,831 | 8/1969 | Lewis | 440/41 |
| 4,231,315 | 11/1980 | Tachibana et al. | 440/43 |
| 4,538,997 | 9/1985 | Haglund | 440/41 |

FOREIGN PATENT DOCUMENTS

| | | | |
|---|---|---|---|
| 42 09 393 | 9/1993 | Germany . | |
| 3-587 | 1/1991 | Japan . | |
| 405112293 | 5/1993 | Japan | 440/41 |
| 405213273 | 8/1993 | Japan | 440/41 |
| 152085 | 4/1985 | Norway . | |
| 154188 | 8/1986 | Norway . | |
| 166402 | 7/1991 | Norway . | |

*Primary Examiner*—Sherman Basinger
*Attorney, Agent, or Firm*—Young & Thompson

[57] ABSTRACT

A water jet propulsion unit for a waterborne craft comprising a propeller pump having a pump housing outside the outlet opening of which there is provided a steering portion which makes possible the turning of the vessel as well as the retarding and reversing thereof. The steering portion includes a support bearing structure mounted at the outlet opening to be swung about a vertical axis designed to have two parallel side plates between which a steering nozzle is pivotally mounted about a horizontal axis. Below the steering nozzle, designed to have a rectangular cross section and between the two side plates, a reversing bucket is pivotally mounted. This reversing bucket is link connected to the steering nozzle so that when the fore end of the steering nozzle is swung upwards, it will swing from a position up under the steering nozzle to a downwardly swung position.

6 Claims, 3 Drawing Sheets

WATER JET AGGREGAT FOR A VESSEL

The invention relates to a water-jet propulsion unit for a waterborne craft comprising a propeller pump having a pump housing which has an inlet opening and an outlet opening, and where at the outlet opening of the pump housing there is provided a steering nozzle having a fore and aft end, and which for directing the water jet is mounted at its fore end to be swung laterally about a vertical axis, and for the purpose of reversing the thrust direction of the unit a bucket is provided on the underside of the steering nozzle which can be swung about a horizontal axis between a position lying outside the water jet to an active position in the water jet.

U.S. Pat. No. 4,474,561 makes known a water-jet propulsion unit of the said type, where connected to the outlet opening of the pump housing is a support in which a steering nozzle for directing the water jet is mounted. This steering nozzle can be swung laterally about a vertical axis. For the purpose of reversing the thrust direction of the unit in order to retard or reverse the vessel, there is also a bucket which can be swung about a horizontal axis between a position lying completely outside the steering nozzle and an active position swung inwardly in the steering nozzle.

One object of the present invention is to provide a water-jet propulsion unit where one can, with greater precision and maintenance of greatest possible reversing thrust, control the driving thrust fore and aft, or hold the vessel still.

According to the invention, a water-jet propulsion unit for a waterborne craft is therefore proposed comprising a propeller pump having a pump housing which has an inlet opening and an outlet opening, and where at the outlet opening of the pump housing there is provided a steering nozzle having a fore and aft end, and which for directing the water jet is mounted at its fore end to be swung laterally about a vertical axis, and for the purpose of reversing the thrust direction of the unit, a bucket is provided on the underside of the steering nozzle which can be swung about a horizontal axis between a position lying outside the water jet and an active position in the water jet. Said water-jet propulsion unit is characterised in that the steering nozzle is substantially rectangular in nozzle cross-section and at its aft end is mounted pivotally about a horizontal axis between two side plates in a support, which is pivotally mounted about a vertical axis at the outlet opening for lateral swinging, and in that the bucket is pivotally mounted about a horizontal axis between the two side plates and is drive-connected to the steering nozzle so that when the fore end of the steering nozzle is swung upward it will swing from a position up under the steering nozzle to a downwardly swung position.

The drive connection between the steering nozzle and the bucket may to advantage be a link connection.

When travelling forward, the waterborne craft is steered in that the support and hence the steering nozzle is swung in the horizontal plane so that the steering nozzle deflects the water jet.

Retarding the vessel when it is in motion, or reversing it, is achieved by establishing a flow passage which deflects the water jet downward and forward beneath the bottom of the vessel. This takes place in that the leading edge of the steering nozzle is swung upward, and via the drive connection causes the bucket to swing downward.

The lower horizontal edge of the steering nozzle, when the steering nozzle is swung up, will gradually cut into the water jet from the outlet opening of the pump housing and cause an increasing amount of water to be deflected in a forward direction. The reversing thrust arises as a result of the water pressure against the bucket.

The vessel is steered in the same way during propulsion astern as during forward propulsion in that the support and hence the steering nozzle and the bucket are swung in the horizontal plane.

Advantageously, the support, in front of the steering nozzle, may have a substantially rectangular opening corresponding to the rectangular cross-section of the steering nozzle and flush with the outlet opening of the pump housing.

It would be particularly advantageous if this opening had a top projection connected from above which extends aftward to the vicinity of the fore end of the steering nozzle, said steering nozzle having a corresponding bottom projection directed forward toward the support opening, said projections being dimensioned so that the bottom projection will abut against the top projection when the fore end of the steering nozzle swings upward. The bottom projection will cut into the water jet and cause an increasing amount of water to be deflected in a forward direction via the bucket.

It would be particularly expedient if the breadth of the aperture of the steering nozzle were to decrease in the aftward direction. This will contribute to a better response during steering swings, since the water jet will go against the more inwardly swung wall and give response thrust.

To obtain the greatest possible reversing thrust, which is due to the water pressure against the bucket, the reversing passage formed by the bucket must have a cross-section that is large enough to allow the whole jet discharge to pass. If this reversing passage is too narrow, it could result in damming up and backflow, with reduced reversing thrust.

Therefore, the bucket is to advantage designed to have a width greater than the width of the steering nozzle at the aft end. This means that the reversing passage can be made substantially wider than the outlet width of the steering nozzle so that with the same passage width in the vertical plane one may have a substantially larger flow cross-section than is the case, for example, in the known embodiment mentioned above, where the width of the reversing passage will be limited to the outlet width of the steering nozzle.

The invention will now be explained in more detail with reference to the drawings, wherein.

Figure 1:
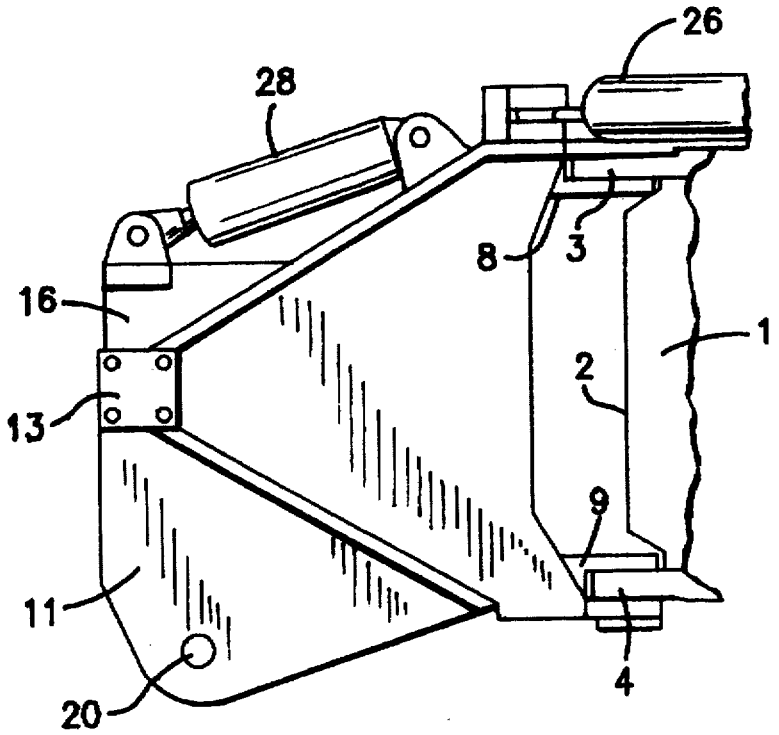
FIG. 1 is a side view of the steering portion of a water-jet propulsion unit for a waterborne craft.

In the drawings, the outlet opening of a pump housing 1 in a water-jet propulsion unit for a waterborne craft is designated by means of the reference numeral 2. The outlet opening is circular and emits a water jet as provided by the water-jet propulsion unit propeller pump (not shown) inside the pump housing 1.

From the pump housing 1 project an upper 3 and a lower 4 lug. Each of these lugs has a vertical bore in which is housed a respective swing bolt 5,6. By means of an upper 8 and a lower 9 fork, a support 7 is pivotally mounted in the two lugs 3,4 by means of the pivots 5,6.

The support 7 is a box-shaped bearing structure, having two parallel side plates 10,11 which extend aftward and at the respective aft edge are designed to have swing bearings 12,13 for horizontal pivots 14,15 for a steering nozzle 16.

The steering nozzle 16 is constructed in the form of a rectangular tube from the bottom wall of which projects a bottom projection 17. This bottom projection extends forward to a rectangular opening 18 in the support 7. This rectangular opening in the support is located outside the outlet opening 2 of the pump housing 1 and has a top projection 19 connected from above, forming a part of the bearing structure of the support. When the fore end of the steering nozzle 16 is swung upward the bottom projection 17 will abut against the top projection 19 (see FIG. 5).

Beneath the steering nozzle 16, a reversing bucket 21 is pivotally mounted between the side plates 10,11 by means of two pivots 20. The bucket 21 is by means of a link 22 link-connected to the steering nozzle 16. The respective pivots of the link 22 are designated 23, in the steering nozzle 16, respectively 24, in the bucket 21. As can be seen, this link connection is such that when the fore end of the steering nozzle swings upward the bucket 21 will swing downward, as can be seen in the sequence in FIGS. 3 to 5. The link connection is of a geometry such that when the steering nozzle is swung upward as mentioned, the reversing bucket will first move quickly downward and then move relatively little. The object of this is to be able to establish quickly a reversing jet, which always or at least to the greatest extent possible goes clear of the hull of the vessel.

Figure 2:
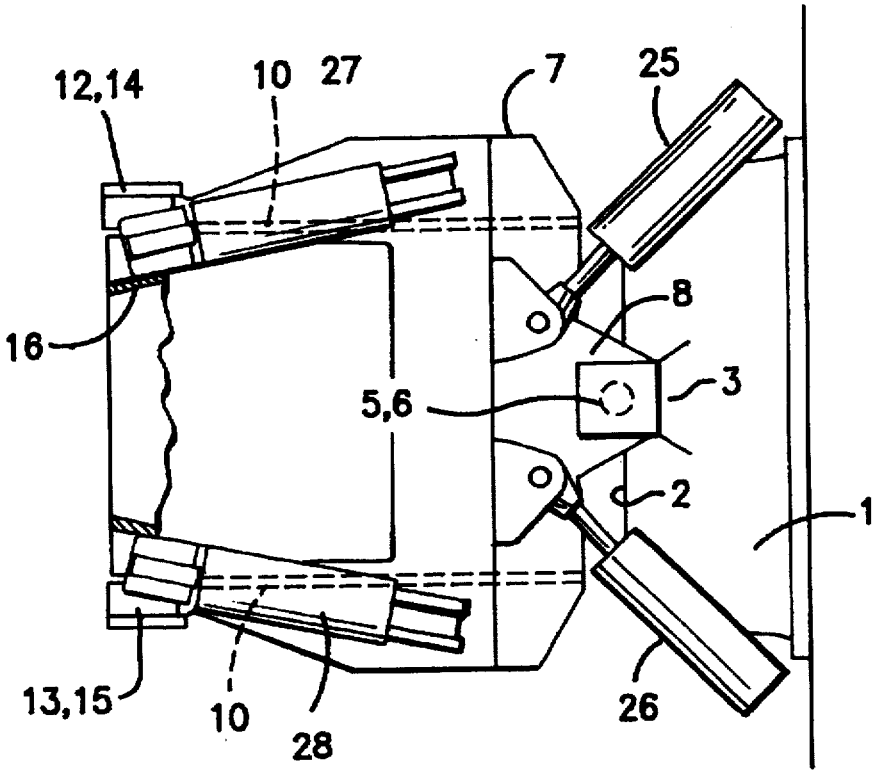
FIG. 2 is a horizontal projection of the steering portion in FIG. 1.

The steering nozzle 16 has, as mentioned, a substantially rectangular cross-section, and the width thereof decreases in. the aftward direction, see FIG. 2.

The bucket 21, however, has a constant width and in the exemplary embodiment will have a width that is greater than the outlet width of the steering nozzle. The reversing thrust is due to the water pressure against the bucket. As the total energy of the water is constant, apart from loss, some of the speed energy will be converted into pressure energy when the water flows through the curved part of the passage formed by the bucket. Since the speed is reduced, the flow cross-section will be greater here than in the case of a straight jet. To obtain greatest possible reversing thrust, the reversing passage formed by the bucket must have a cross-section large enough to allow the whole jet discharge to pass. If the passage is too narrow, this will result in damming up and backflow, and a reduced reversing thrust.

The whole of the above-described steering portion of the water-jet propulsion unit can be swung laterally about the pivots 5,6 by means of two hydraulic fluid power cylinders 25,26. These are only shown in FIGS. 1 and 2 and are then omitted from FIGS. 3 to 5 to simplify matters.

The steering nozzle 16 can be swung in the vertical plane by means of two fluid flow cylinders 27,28.

Figure 3:
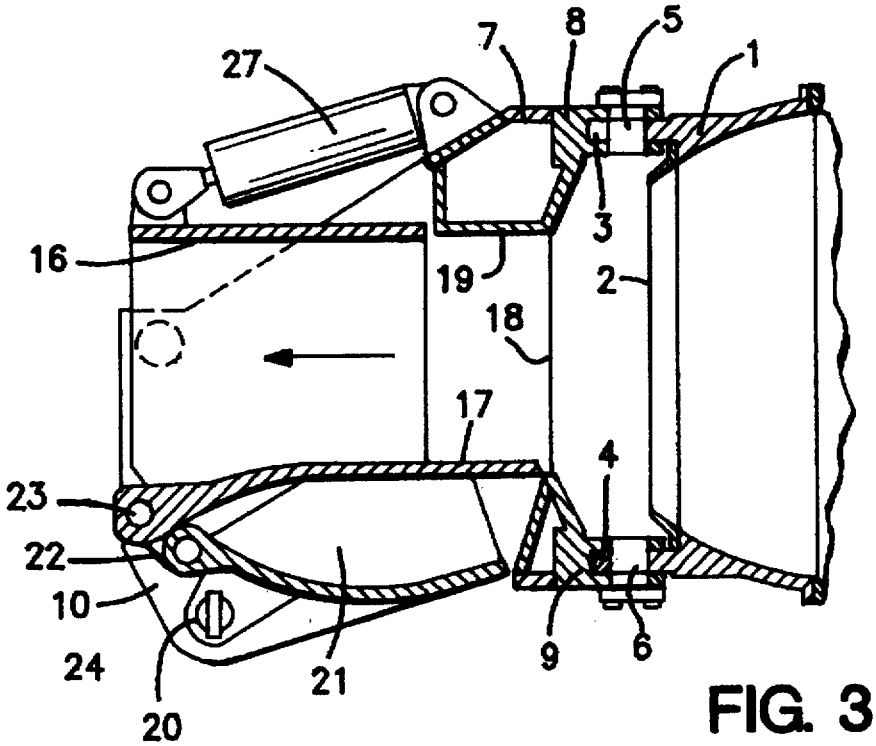
FIG. 3 shows a cross-section through the steering portion in the normal operational position thereof.

The invention functions in the following way. In FIG. 3, the steering nozzle 16 is shown in its normal position, i.e., directed inward and flush with the outlet opening 2 and the opening 18 in the support 7. The water jet, which comes from the outlet opening 2, passes through the rectangular opening 18 and into the forward rectangular opening in the steering nozzle 16 and continues through the steering nozzle, as indicated by the arrow, and passes out through the aft end of the steering nozzle.

If it is desired to turn the vessel, the support 7 is swung and hence also the steering nozzle 16 about the central pivots 5 and 6 by means of two hydraulic fluid power cylinders 25,26.

Retarding a vessel in motion, or reversing it, is achieved in that the leading edge of the steering nozzle 16, with the aid of the hydraulic fluid power cylinders 27,28 is swung upward, the steering nozzle being swung about the pivots 14,15. Simultaneously with this swinging movement, see FIG. 4, the bucket 21 will be swung downward about its horizontal pivots 20.

The horizontal lower edge, i.e., the projection 17 on the steering nozzle, when the steering nozzle 16 is swung upward, will gradually cut into the water jet and cause an increasing amount of water to be deflected in a forward direction via the bucket 21. By varying the vertical deflection of the steering nozzle, one can therefore with great precision control the propelling thrust forward and aftward, or keep the vessel still.

Figure 4:
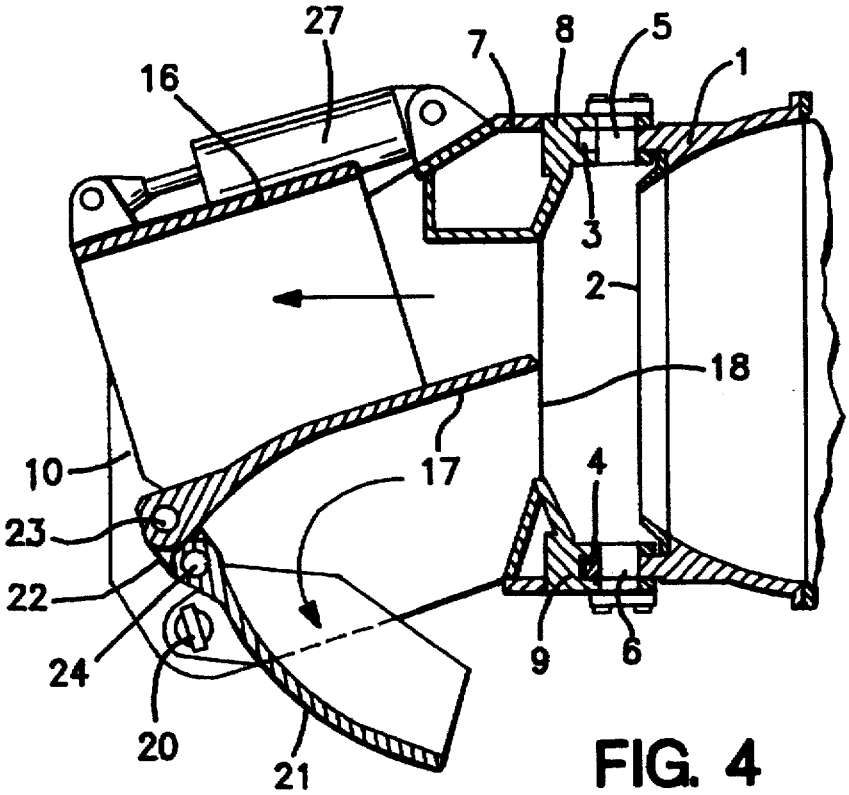
FIG. 4 shows a section through the steering portion, with the steering nozzle in an upwardly swung intermediate position.
Figure 5:
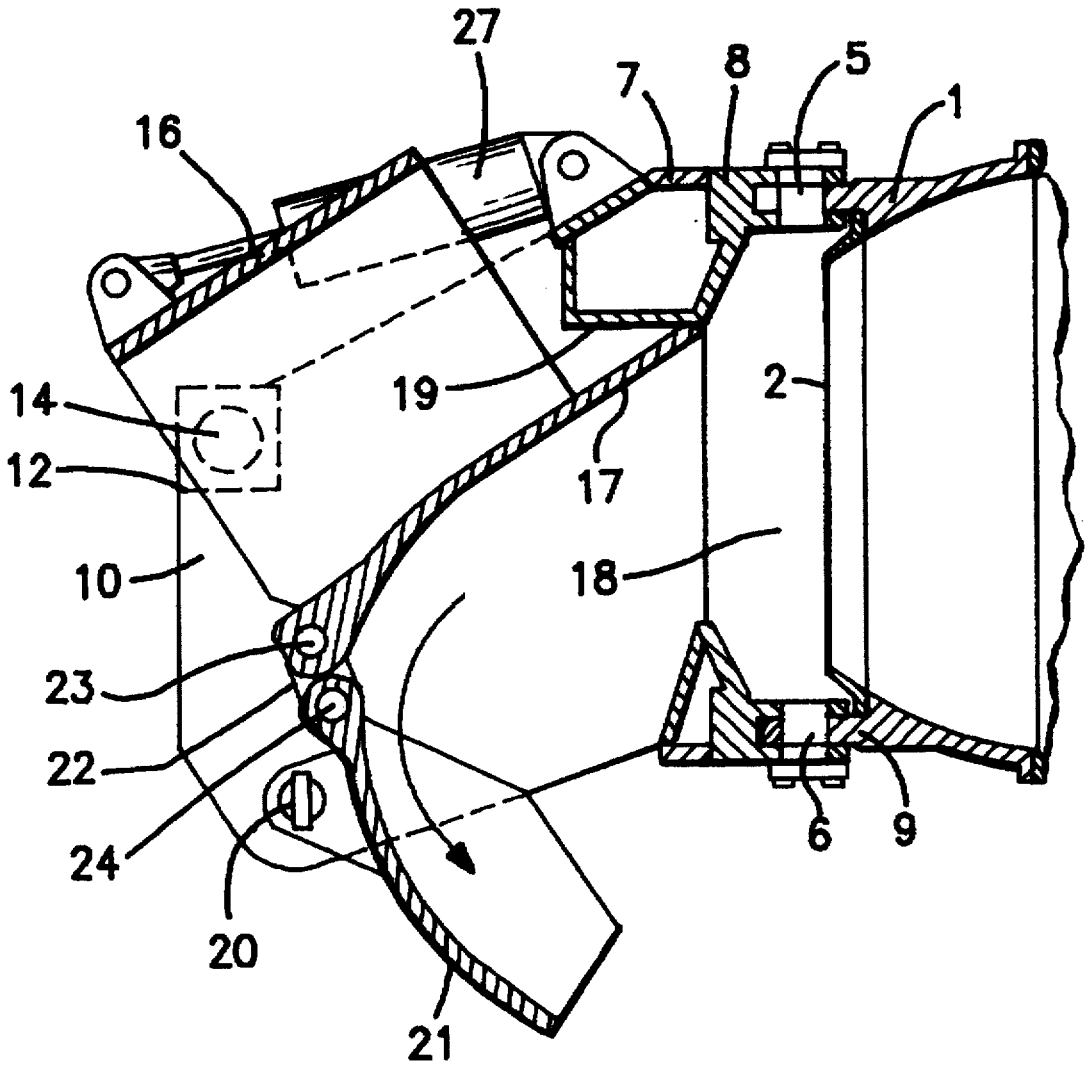
FIG. 5 shows a section as in FIGS. 3 and 4, with the steering nozzle in a fully upwardly swung reversing position.

In FIG. 4 the steering nozzle 16 is shown in a halfway upwardly swung position, where the water jet as shown by the arrows passes in part through the steering nozzle 16 and in part through the reversing passage formed by the bucket 21. In FIG. 5, the steering nozzle 16 is shown swung fully upward, to full reversing position, and it can be seen that now the whole water jet passes into the reversing passage, see the arrow in FIG. 5.

The geometry of the steering nozzle-chains-bucket system is chosen so that when the steering nozzle is swung upward the bucket will first move quickly downward. From the "balanced propelling thrust"position to full reverse, the angle of the reversing bucket will vary little, and be great enough to ensure that the reversing jets always go clear of the hull of the vessel.

When the vessel is propelled astern, it is steered in the same way as during forward thrust in that the whole steering portion is swung about the pivots 5,6. The angle of the reversing jet in the horizontal plane will then be approximately equal to the pivot angle of the steering portion.

In the exemplary embodiment, the drive connection between the steering nozzle and the bucket is shown as a link connection, which gives certain advantages. Other drive connections are, of course, conceivable, for example, interacting toothed segments.

I claim:

1. A water-jet propulsion unit for a waterborne craft comprising a propeller pump having a pump housing (1) which has an inlet opening and an outlet opening (2), and where at the outlet opening (2) of the pump housing (1) there is provided a steering nozzle (16) having a fore and aft end, and which for directing the water jet is mounted at its fore end to be swung laterally about a vertical axis (5,6), and for the purpose of reversing the thrust direction of the unit a bucket (21) is provided on the underside of the steering nozzle which can be swung about a horizontal axis (20) between a position lying outside the water jet and an active position in the water jet, characterised in that the steering nozzle (16) is substantially rectangular in nozzle cross-section and at its aft end is mounted pivotally about a horizontal axis (14,15) between two side plates in a support (7), which is pivotally mounted about a vertical axis (5,6) at the outlet opening (2) for lateral swinging, and in that the bucket (21) is pivotally mounted about a horizontal axis (20) between the two side plates (10,11) and is drive-connected (22–24) to the steering nozzle (16) so that when the fore end of the steering nozzle (16) is swung upwards it will swing from a position up under the steering nozzle to a downwardly swung position.

2. A water-jet propulsion unit according to claim 1, characterised in that the drive connection between the steering nozzle (16) and the bucket (21) is a link connection.

3. A water jet propulsion unit according to claim 2, characterised in that at the opening (18) of the support has a top projection (19) connected from above which extends aftward to the vicinity of the fore end of the steering nozzle (16), said steering nozzle (16) having a corresponding bottom projection (17) directed forward toward the support opening (18), said projections being dimensioned so that the bottom projection (17) will abut against the top projection (19) when the fore end of the steering nozzle (16) swings upward.

4. A water-jet propulsion unit according to claim 1, characterised in that the support (7) in front of the steering nozzle (16) has a substantially rectangular opening (18) corresponding to the rectangular cross-section of the steering nozzle (16) and flush with the outlet opening (2) of the pump housing (1).

5. A water-jet propulsion unit according to claim 1, characterised in that the aperture width of the steering nozzle decreases in the aftward direction.

6. A water-jet propulsion unit according to claim 1, characterised in that the bucket (21) has a width greater than the width of the steering nozzle (16) at the aft nozzle end.

* * * * *